United States Patent [19]

Vuille et al.

[11] 3,956,881

[45] May 18, 1976

[54] HAIRSPRING AND COLLET ASSEMBLY FOR TIMEPIECES

[75] Inventors: Pierre-Alain Vuille, Tramelan; Eric Favre, Grenchen; Friedrich Perrot, Lengnau, all of Switzerland

[73] Assignee: ETA A.G. Ebauches-Fabrik, Switzerland

[22] Filed: June 16, 1975

[21] Appl. No.: 587,054

[30] Foreign Application Priority Data

June 25, 1974 Switzerland ..... 8714/74

[52] U.S. Cl. ..... 58/115; 58/140 R

[51] Int. Cl.² ..... G04B 17/32

[58] Field of Search ..... 58/107, 114, 115, 140 R

[56] References Cited

UNITED STATES PATENTS

| | | | |
|---|---|---|---|
| 3,274,766 | 9/1966 | Desaules et al. | 58/115 |
| 3,395,532 | 8/1968 | Schneider | 58/115 |
| 3,429,120 | 2/1969 | Charpilloz | 58/115 |
| 3,623,314 | 11/1971 | Schneider | 58/115 |
| 3,673,376 | 6/1972 | Kullmann | 58/115 X |
| 3,696,687 | 10/1972 | Harland | 58/114 X |
| 3,735,586 | 5/1973 | Berney | 58/114 |
| 3,842,592 | 10/1974 | Giger | 58/115 |
| 3,846,612 | 11/1974 | Augsburger | 58/115 X |
| 3,868,490 | 2/1975 | Aeschlimann et al. | 58/115 X |
| 3,906,714 | 9/1975 | Schneider | 58/115 |

*Primary Examiner*—L. T. Hix
*Assistant Examiner*—Stanley J. Witkowski
*Attorney, Agent, or Firm*—Stevens, Davis, Miller & Mosher

[57] ABSTRACT

A hairspring and collet assembly for timepieces in which the collet has a base having an opening and a stud integral from the base in a direction parallel to the axis of the opening. The hairspring comprises an inner turn ending in a bend. The stud occupies a portion of the base extending between the opening and the periphery of the base. The non-deformed portion of the inner turn of the hairspring is secured to the stud and the bend extends freely away from the stud about the opening.

13 Claims, 4 Drawing Figures

HAIRSPRING AND COLLET ASSEMBLY FOR TIMEPIECES

Figure 1:
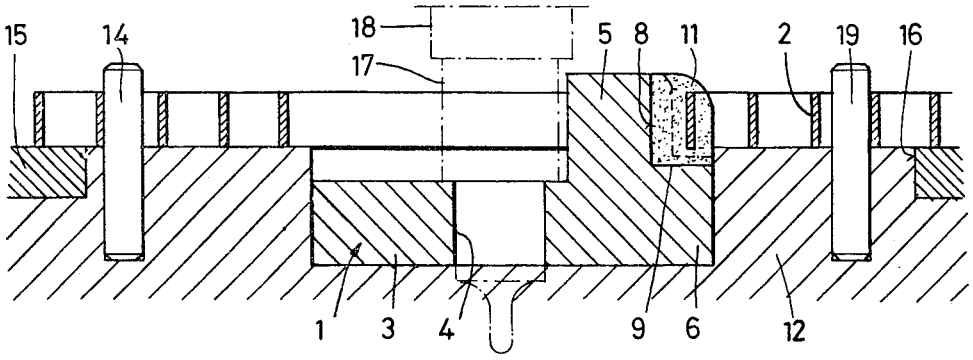

This invention relates to a hairspring and collet assembly for timepieces in which the collet is composed of a base having an opening adapted for engagement on a balance-staff and of a stud integral with the base and projecting from face of the base in a direction parallel to the axis of the opening.

Hairsprings for timepieces are known to be shaped by means of a spring-winder. This tool enables several hairsprings to be wound simultaneously, and its construction is such that it necessarily forms a bend at the inner end of each of them; the size and positioning of these bends are, however, irregular.

The classic method of producing the collet and hairspring assembly consists in using a cylindrical collet having a straight hole or a slot in its thickness. It is necessary to cut off part of the last turn of the hairspring and the bend formed by the spring-winder, after which a new bend is made in the end of the last turn under sufficiently precise conditions to ensure that when it is inserted in the hole or slot of the collet and blocked by a pin or other outside member, the hairspring will be at least substantially flat. In general, an additional operation for flattening the hairspring is necessary, consisting in correcting the bend.

Assemblies are also known in which the means for affixing the last turn to the collet do not utilize any bend. There, all or part of the periphery of the collet comprises a lateral surface which may either be cylindrical and centered on the collet opening, slightly off-center with respect to that opening, or helical. The operation of cutting off the initial bend and part of the last turn of the hairspring must then be carried out very carefully and exactly, for any risk of buckling must be avoided, and the ahirspring must be cut so that its inner end has a precisely determined radius. On the other hand, the operation of forming a new bend is eliminated. The last turn of the hairspring lies against the lateral surface of the collet at one or more points or in one or more zones, and the fixing means used in this case may consist of riveting, soldering, or cementing at one or more points. Fixing means are also known which secure the last turn of the hairspring to the lateral surface of the collet by wedging.

These assemblies enable the last turn of the hairspring to be joined to the collet without deforming the hairspring; this considerably reduces the risks of faulty flattening and consequently simplifies or even eliminates subsequent flattening operations. Another advantage of these known assemblies is that the point at which the hairspring becomes free may be brought back much closer to the axis of the balance than with the classic assemblies in which a bend is formed for affixing the inner end of the hairspring. As a result, the isochronism is improved, and the variations in rate of the watch, measured between the different positions, are reduced. When the last turn of the hairspring is secured to the collet without deformation, the point where the hairspring becomes free is determined by the size of the collet or, to be exact, by the radius of the lateral surface to which the hairspring is affixed. This radius must be determined at the time of manufacture, and the inner end of the hairspring must be cut off as a function of that dimension. It is then possible to construct the movement and to situate the position of the hairspring-stud taking the regulating point for pinning-up into account, which simplifies construction since it is then no longer necessary to provide a movable stud-holder at the outer end of the spiral spring. The timing operations are likewise simplified.

It is the object of this invention to provide an assembly composed of a timepiece hairspring and a collet having all the advantages of the assemblies in which the inner turn of the hairspring is fixed without deformation, but which are simpler to produce than the known assemblies. More particularly, the invention aims at eliminating the operation of cutting off part of the last turn of the hairspring and the hook or bend formed by the spring-winder, which operation has heretofore had to be carried out with great precision in those assemblies in which the hairspring is not deformed.

To this end, in the hairspring and collet assembly according to the present invention, the hairspring comprises an inner turn ending in a bend, the stud of the collet occupies a portion of the surface of the base extending between the opening and the periphery of the base and comprises a lateral surface for receiving the hairspring, and the assembly comprises fixing means for securing a non-deformed portion of the inner turn to the aforementioned lateral surface, the end of the inner turn and the bend extending freely away from the stud of the collet about the opening.

Figure 2:
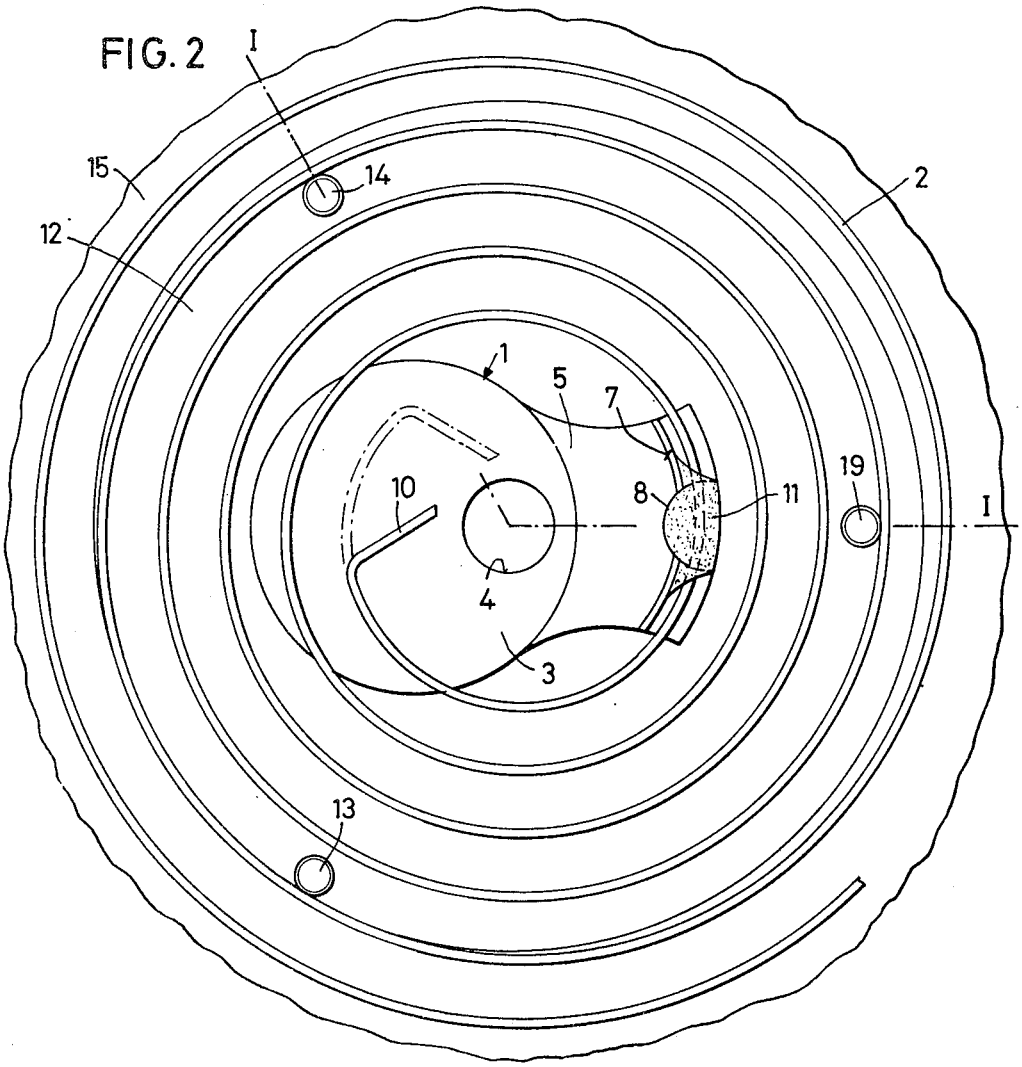
Figure 3:
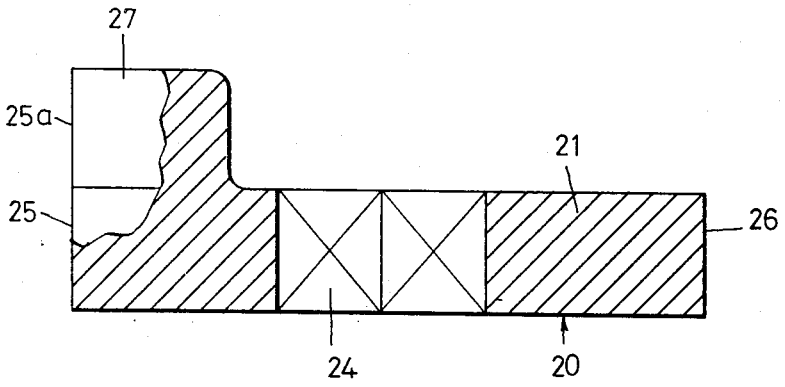
Figure 4:
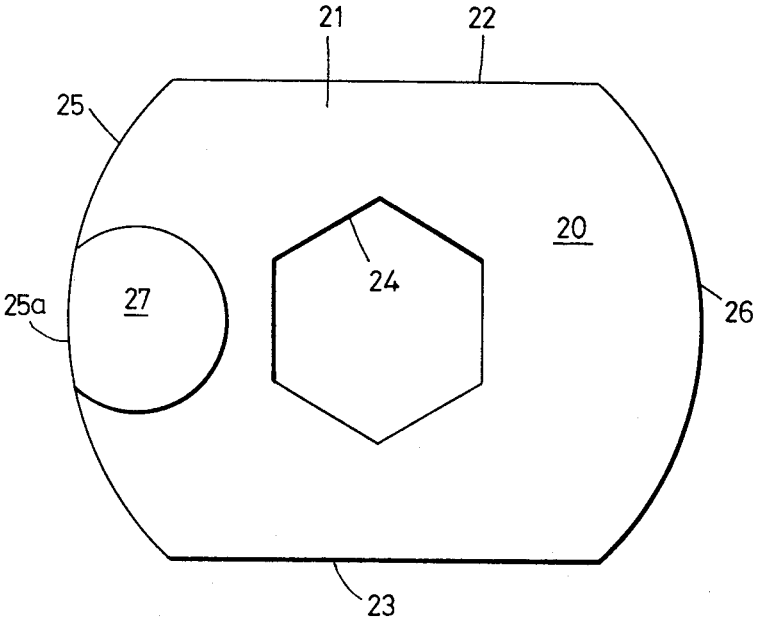

Two possible embodiments of the invention will now be described in detail with reference to the accompanying drawings, in which:

FIG. 1 is an axial sectional view of the first embodiment, only part of the hairspring being shown, FIG. 2 is a top plan view, and FIGS. 3 and 4 are sectional and top plan views, respectively, of the collet forming part of the second embodiment of the assembly.

FIGS. 1 and 2 disclose a collet 1 and a hairspring 2 of a mechanical watch movement. The collet 1 is a stamped and blanked metal part which comprises a base 3 having a cylindrical opening 4 and a stud 5 projecting from the base 3 in a direction parallel to the axis of the opening 4. The base 3 is circular in plan, the opening 4 being off-center with respect to the contour of this part of the collet 1. The base 3 also has a lateral extension forming the base of the stud 5 and a rim 6 extending beyond the stud 5. The stud 5 is delimited radially by a lateral surface 7 in the shape of an arc of a cylinder which may be coaxial with the opening 4 or slightly off-center with respect to that axis. In the latter case, the axis of the surface 7 is parallel to that of the opening 4. In the center of the lateral surface 7 is a groove 8 having an arcuate profile and running parallel to the axis of the opening 4. In the embodiment shown, the groove 8 extends into the thickness of the rim 6 and ends in a plane surface 9 situated slightly lower than the upper surface of the rim 6. As a variation, however, the groove 8 might end flush with the upper surface of the rim 6 or pass all the way through the collet 1. As may be seen in FIG. 1, the rim 6 is slightly thicker than the rest of the base 3. However, these two parts might equally well be of the same thickness. The collet 1 has no slot between the opening 4 and the lateral surface of the base 3, but such a slot might also be provided, if need be. The various parts of the collet 1 are so proportioned that the whole of the collet 1 and the means for fixing the hairspring 2 are balanced with respect to the axis of the opening 4.

The hairspring 2 is a conventional watch hairspring which has the particularity of still possessing a spring-winding bend 10. It is fixed to the collet 1 by a mass of cement 11 which adheres to the bottom of the groove 8, to the portions of the cylinder-arc surface 7 adjoining the groove 8, to the end surface 9 of the groove 8, and finally to a portion of the upper surface of the rim 6. A section of the inner turn of the hairspring 2 passes through and is embedded in the mass of cement 11. Thus the hairspring 2 extends freely outward starting from the point where it leaves the mass of cement 11, and its last turn is also free towards the inside, with the bend 10 being situated above the base 3 at a certain distance from its upper surface at a point approximately opposite the groove 8 with respect to the opening 4.

It will be understood that the constant-pitch spiral curve defining the hairspring 2 must have its origin or center of gravity on the axis of the opening 4, the diameter of which matches that of a portion of the balance-staff. The lengths and positions of the bends 10 formed in practice during the manufacture of the hairsprings are such that, in the assembly described, they are generally situated outside the limits of the opening 4, which allows the subsequent mounting of the assembly on the balance. Even if the bend 10 does overlap the opening 4 partially, it will be pushed away when the collet 1 is driven onto the staff, and this represents no drawback.

Thus, owing to the shape of the collet 1, it is possible to fix the hairspring 2 to it without the preliminary operation of cutting off the spring-winder bend and part of the last turn of the hairspring.

The centering of the hairspring may, for example, be carried out in the following manner: the collet 1 is placed in a matching recess in a table 12. Fixed in the table 12 are three centering pins 13, 14, and 19, positioned according to the location of the groove 8 and of the lateral surface 7 when the collet 1 is placed in its recess, and as a function of the size of the hairspring. Placed on the table 12 is a rotatable ring 15 having a circular central aperture 16 which is engaged on a raised portion of the table 12 and which can rotate about the axis of the opening 4.

The hairspring 2 is placed on the ring 15 in such a way that one of its turns rests against the pins 13 and 14 while its inner turn passes in front of the lateral surface 7. It is then rotated by means of the ring 15 so that it tightens about the pins 13, 14, and 19. The portion of the last turn of the hairspring 2 which faces the surface 7 and the groove 8 then comes to be positioned at exactly the desired distance from those elements of the collet 1. As the thickness of the ring 15 is so chosen that the hairspring 2 does not come in contact with the upper surface of the rim 6, nor with the upper surface of the rest of the base 3, it is not in contact with the collet 1 at any point. The desired radial spacing between the last turn of the hairspring 2 and the cylindrical surface 7 may be adjusted by rotation of the ring 15, after which the latter is fixed for the cementing operation. At that moment, the spring-winder bend 10 is situated above the base 3, either at the location shown in solid lines in FIG. 2 or at some other location, e.g., that indicated by the dot-dash outline in FIG. 2, depending upon the variations, due to the spring-winding operation, in the several hairsprings of a series. It has been found that the variations within a single series are slight enough so that the bend 10 is always situated within an angle of about 180° having its apex at the axis of the opening 4. Once the hairspring 2 has thus been positioned in height by the ring 15 and centered on the axis of the opening 4, it suffices to place in the groove 8 the drop or lump of cement which will solidify into the mass 11. This drop or lump constitutes the sole means used for fixing the hairspring.

It will be noted that when the rim 6 is thicker than the rest of the base 3 and when the groove 8 runs axially into the thickness of the rim 6, as shown in the drawing, the hairspring 2 might also be placed at a height where it would be in contact with the upper surface of the rim 6. The lateral surface 7 might also be so dimensioned that the hairspring 2 comes to lie against it at the location of the affixing means. In this case, the cylinder-arc surface 7 should have its axis slightly shifted with respect to that of the opening 4, the shift being such that the surface 7 would be substantially merged with a spiral surface portion corresponding to the inner surface of the hairspring 2. The lateral surface 7 might also constitute the inner side of an arcuate groove in the upper surface of the stud 5.

Finally, the use of a collet comprising a base and a projecting stud, such as that described above, and of a hairspring still having the spring-winder bend at its inner end, might equally well be combined with fixing means other than a mass of cement. Thus the middle portion of the last turn of the hairspring might be fixed to the stud of the collet by riveting in a groove made in the lateral surface 7 of the stud, or by soldering, or even by means of a detachable fastening member.

Whatever fixing means are used, the dimensions of the collet 1 will be so chosen that their weight, i.e., that of the mass of cement 11 or, as the case may be, that of the detachable fastening members, will likewise be balanced by the base 3.

FIG. 1 shows in dot-dash lines a staff 17 of a balance, the cylindrical bearing surface 18 of which, intended to receive the balance proper, is situated on the same side of the base 3 as the stud 5. The collet 1 may therefore be driven onto the cylindrical bearing surface of the staff 17 which is intended to receive it, with the driving tool coming to rest on the plane surface of the base 3 which is opposite the stud 5. Hence there is no risk that the stud 5 itself and the hairspring 2 will be damaged by the driving operation.

As the direction of winding of a timepiece hairspring is defined by considering this hairspring when it is mounted on the balance, and by looking at it from above, the balance being turned so that the hairspring is situated above the balance proper, if the hairspring 2 is a right-hand one, i.e., one where the direction of winding is to the right when the spring, placed on the ring 15, is viewed from above, then when the assembly composed of the hairspring 2 and the collet 1 is mounted on a balance, it will constitute an assembly having a left-hand direction of winding, or vice versa. This inversion stems from the fact that hairsprings are usually fixed to the collet, then mounted on the balance without first being turned over.

It has been found that the bend 10 and the end of the last turn of the hairspring which is left free do not disturb the functioning of the oscillating system. Thus the assembly described presents all the advantages of the assemblies in which the hairspring is fixed to the collet without deformation of the inner turn. The latter has the smallest possible radius imposed by the spring-winding of the hairspring, and any risk of deformation is completely eliminated. What is more, owing to the omission of the delicate operation of cutting off the central hook deriving from the manufacture of the hairspring, it is simpler to produce than that of the known assemblies of the same type.

In certain cases, especially when soldering is used as the means for fastening the hairspring to the fixing stud, it may be expedient to use a steel collet. On the other hand, in the embodiment described above, the base of the collet has a totally-enclosed opening 4. This circular opening is fitted to the size of the balance-staff so as to engage on that staff with a relatively tight friction-fit. The use of a split collet would be liable to decrease the precision of the positioning of the stud about the axis of the balance and would consequently not allow the same precision of adjustment to be obtained. If, however, the collet is made of steel, with a cylindrical hole fitted to the size of the staff, there is liable to be difficulty in mounting the collet. The embodiment illustrated in FIGS. 3 and 4 avoids such difficulties. In that embodiment, the collet 20 is a steel part obtained by stamping and blanking which comprises a circular base 21 having two parallel flats 22 and 23. Between a central opening 24 and one of the arcuate surfaces 25 and 26 of the collet 20 is a stud 27 which projects from the flat upper surface of the base 21. The stud 27, having an arcuate contour, is delimited towards the outside by a surface portion 25*a* forming a continuation of the cylinder-arc surface 25.

In order to allow a friction-mounting of the collet on the balance-staff, the opening 24 is blanked in the shape of a hexagon so that just the middles of the plane faces press against the cylindrical surface of the staff. This arrangement gives the inner surface of the opening the necessary elasticity to enable adjustment of the collet on the balance-staff.

What is claimed is:

1. A hairspring and collet assembly for timepieces in which said collet is composed of a base having an opening adapted for engagement on a balance-staff and of a stud integral with said base and projecting from a face of said base in a direction parallel to the axis of said opening, wherein said hairspring comprises an inner turn ending in a bend, said stud occupies a portion of the surface of said base extending between said opening and the periphery of said base and comprises a lateral surface for receiving said hairspring, and said assembly comprises fixing means for securing a non-deformed portion of said inner turn to said lateral surface, the end of said inner turn and said bend extending freely away from said stud about said opening.

2. An assembly in accordance with claim 1, wherein said fixing means is a solidified mass of cement adhering to a portion of said inner turn and to said stud.

3. An assembly in accordance with claim 2, wherein said lateral surface has the shape of an arc of a cylinder, and said inner turn faces said lateral surface without touching it.

4. An assembly in accordance with claim 3, wherein said lateral surface is off-center with respect to said opening.

5. An assembly in accordance with claim 2, wherein said lateral surface has the shape of an arc of a spiral.

6. An assembly in accordance with claim 3, wherein said base forms a rim extending radially at the foot of said lateral surface, and said mass of cement adheres to said rim.

7. An assembly in accordance with claim 5, wherein said hairspring is situated at a height above said rim without touching it.

8. An assembly in accordance with claim 1, wherein said hairspring is fixed to said stud by soldering.

9. An assembly in accordance with claim 1, wherein said stud comprises an arcuate slot having its axis parallel to that of said opening, and said fixing means consist of a riveting or cementing of a portion of said inner turn in said slot.

10. An assembly in accordance with claim 1, wherein said bend is situated substantially opposite said fixing means with respect to said opening.

11. An assembly in accordance with claim 1, wherein said base comprises a plane surface perpendicular to the axis of said opening, said end of said inner turn and said bend being situated above said plane surface without touching it.

12. An assembly in accordance with claim 1, wherein said base is of a uniform thickness over its entire surface, and its contour and dimensions are so determined that said collet as a whole is balanced, said opening being disposed off-center in said base.

13. An assembly in accordance with claim 1, wherein said lateral surface comprises a groove, the bottom of said groove forming an arc of a cylinder and the sides of said groove being plane and perpendicular to the axis of said opening, and wherein said fixing means consist of a riveting of a portion of said inner turn in said groove.

* * * * *